United States Patent [19]

Gensheimer

[11] 4,332,194

[45] Jun. 1, 1982

[54] ARRANGEMENT FOR REDUCING VIBRATION OF CYLINDERS IN PRINTING PRESS

[75] Inventor: Valentin Gensheimer, Muhlheim am Main, Fed. Rep. of Germany

[73] Assignee: M.A.N.-Roland Druckmaschinen Aktiengesellschaft, Fed. Rep. of Germany

[21] Appl. No.: 225,419

[22] Filed: Jan. 15, 1981

Related U.S. Application Data

[63] Continuation-in-part of Ser. No. 205,123, Nov. 10, 1980, abandoned.

[30] Foreign Application Priority Data

Nov. 9, 1979 [DE] Fed. Rep. of Germany ..... 2945280

[51] Int. Cl.[3] ..... B41F 7/02; B41F 13/08

[52] U.S. Cl. ..... 101/216; 101/142; 101/415.1

[58] Field of Search ..... 101/216, 219, 415.1, 101/137, 217, 142, 378, 218, 141, 143, 144, 145

[56] References Cited

U.S. PATENT DOCUMENTS

| | | | |
|---|---|---|---|
| 2,447,991 | 8/1948 | Stempel | 101/217 |
| 2,986,085 | 5/1961 | Johnson | 101/217 X |
| 3,395,638 | 8/1968 | Kirkus | 101/216 |
| 3,453,955 | 7/1969 | Seel et al. | 101/216 |
| 3,453,956 | 7/1969 | Ellis et al. | 101/217 |
| 4,149,461 | 4/1979 | Simeth | 101/216 |

*Primary Examiner*—William Pieprz
*Assistant Examiner*—Charles Pearson
*Attorney, Agent, or Firm*—Leydig, Voit, Osann, Mayer & Holt, Ltd.

[57] ABSTRACT

A rotary printing press having first and second cylinders in rolling engagement, the first cylinder being rigid and the second cylinder being resiliently covered, both of the cylinders having a longitudinal groove defining a gap in the cylinder surface, the gaps being rotated in opposed synchronism with one another. The groove in the first cylinder defines leading and trailing end walls with the end walls terminating at lips at the cylinder surface, the lips on the end walls each having bead projections which extend longitudinally therealong and which project a small distance outwardly from the nominal radius dimension of the cylinder thereby causing the lip on the leading end wall of the first cylinder to engage the surface of the second cylinder earlier than it would in the absence of a bead and causing the lip on the trailing end wall to separate from the surface of the second cylinder later than it would in the absence of the bead thereby to extend the pressure build-up and pressure drop-off angles between the cylinders and to cause a more gradual build-up of pressure between them to the operating level as well as a more gradual decrease from the operating level.

8 Claims, 6 Drawing Figures

FIG. 1.
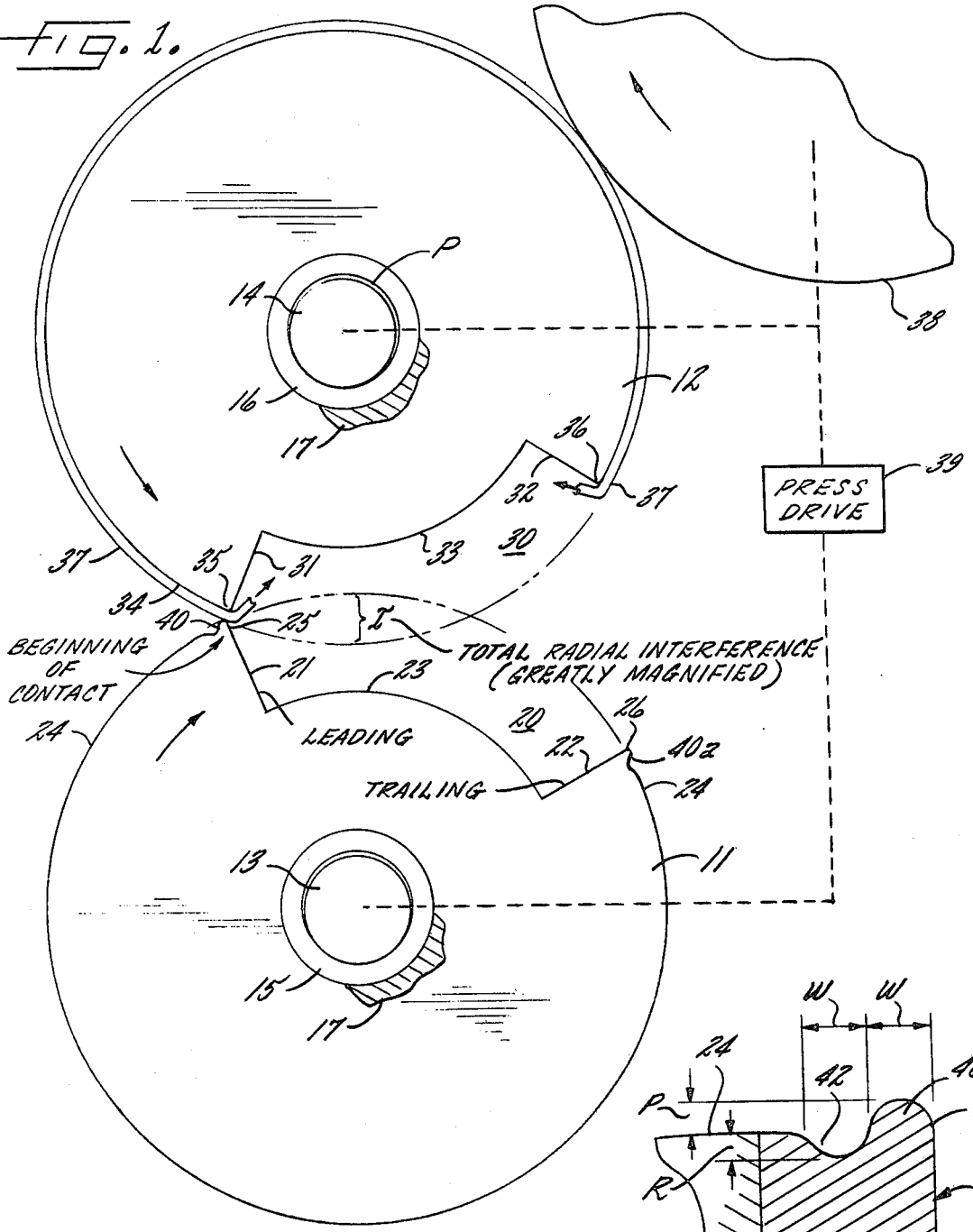
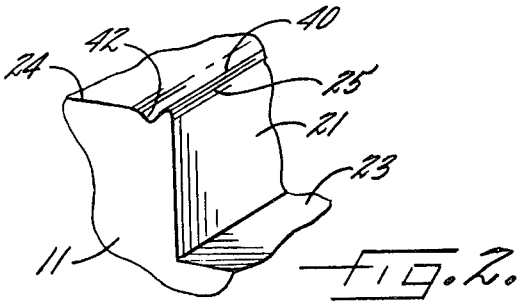
FIG. 2.
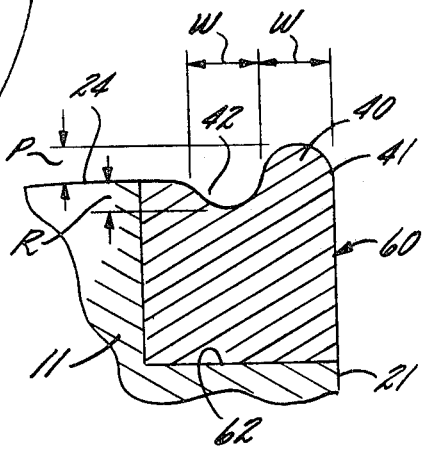
FIG. 22.

(PRIOR ART AT 51 IN FIG. 6.)

ARRANGEMENT FOR REDUCING VIBRATION OF CYLINDERS IN PRINTING PRESS

This is a continuation-in-part of application Ser. No. 205,123 filed Nov. 10, 1980, now abandoned.

In a conventional lithographic press the impression cylinder and blanket cylinders, which are in rolling engagement with one another, are biased, or prestressed, together to develop an operating level of printing pressure. It is customary in both of the impression cylinder and blanket cylinder to provide longitudinal grooves for the accommodation of take-up and tensioning devices for the blanket on the blanket cylinder and for the thin cover on the impression cylinder forming non-printing gaps in the surface. When the grooves in the two cylinders are opposite one another the mutual pressure is reduced to zero. As the leading edges of the printing area defined by the grooves engage one another there is a sudden build-up of pressure to the operating level. Conversely when a printing cycle has been completed and the grooves are again in opposed relation a sudden drop-off in pressure occurs from the operating level back to zero.

The sudden increase in pressure at the beginning of a printing cycle produces relative outward shifting of the cylinder axes because of the play on the bearings and since the cylinders, being elastic, tend to retreat from the applied force. When the operating pressure is released at the end of the printing cycle, the cylinders tend to "drop" toward one another as the force which took up the bearing play is now released, and the cylinders, in addition, tend to elastically straighten back to their original condition. These rapidly succeeding displacements, first in one direction and then in the other, produce cylinder vibration which is particularly troublesome at high speeds, being evidenced by stripes in the printed product extending in the axial direction. At certain speeds a condition of resonance can be set up further aggravating the striping of the product.

Much effort has gone into attempts to overcome cylinder vibration. For example, in U.S. Pat. No. 4,149,461 there is shown the use of rollers for providing artificial support of the cylinders in printing position during the interval of passage of the gaps. Also it has been conventional wisdom to cushion or relieve the "lip" portion of the printing surface, adjacent the leading and trailing edges defined by the groove, for the purpose of cushioning, or postponing, initial impact. Thus German Disclosure Specification 1,636,312 shows use of an elastically deformable cushion in the region of the leading edge of the printing zone while German Disclosure Specification 2,613,687 shows the provision of flatted areas along the edge of the gap.

Thus emphasis in the past has been on relieving of the initial impact and not upon reducing the rate of change of force between the cylinders from zero to the operating level.

Accordingly, it is an object of the present invention to provide a cylinder for printing presses having a groove but which instead of cushioning or flatting the lip at the edge of the groove, intentionally raises the level of the lip by forming it into a bead, the effect of which is to reduce the rate of build-up of printing force from zero to the operating level and conversely, to reduce the rate of drop-off from the operating force back to zero at the groove location. Stated in other words, it is the purpose of the present invention to enlarge the pressure build-up angle and pressure drop-off angle with the result that the rate of build-up and drop-off are decreased thereby bringing about reduction in cylinder vibration, particularly at high operating speeds. Thus it is an object of the invention to provide means for reducing the vibration of printing cylinders which not only constitutes an improvement over conventional vibration-reducing means and which, indeed, flies in the face of prior teachings.

It is another object of the present invention to provide means for reducing vibration between cooperating grooved cylinders, which are respectively rigid and resiliently covered, by making a minor modification of the rigid cylinder in the region of initial impact, a modification which is inexpensive and which may be incorporated in both new cylinders and, by retrofit, cylinders already in the field. It is a related object to provide a modification which can be easily and cheaply performed and which brings about a disproportionate improvement in the smoothness of press operation, particularly when operating at a high production rate.

It is a more detailed object to provide an upraised bead on a portion of a rigid cylinder which is conventionally cushioned or undercut but which is so formed, including an adjacent recess, as to be substantially non-wearing upon the cooperating blanket; in other words, it is an object to provide a vibration-reducing change which utilizes the resilient characteristics of a cooperating blanket but which does not result in any substantial increase in the degree of blanket wear.

As a result of the above, it is an object of the invention to provide means for substantially reducing the degree of "striping" of the printed product due to cylinder vibration, and which therefore results in improved quality and value of the printed product.

Other objects and advantages of the invention will become apparent upon reading the attached detailed description and upon reference to the drawings in which:

FIG. 1 is an elevational diagram showing the impression and blanket cylinders of a typical lithographic printing press upon engagement of the printing areas of the cylinders following synchronized passage of the opposed grooves in the cylinders.

FIG. 2 is a fragmentary perspective showing the use of a projecting bead along the lip of the groove with its associated inboard recess.

FIG. 2*a* is a fragmentary cross section taken transaxially through the structure of FIG. 2 and showing the projecting bead and adjacent recess formed in a bar-shaped insert.

Figure 3:
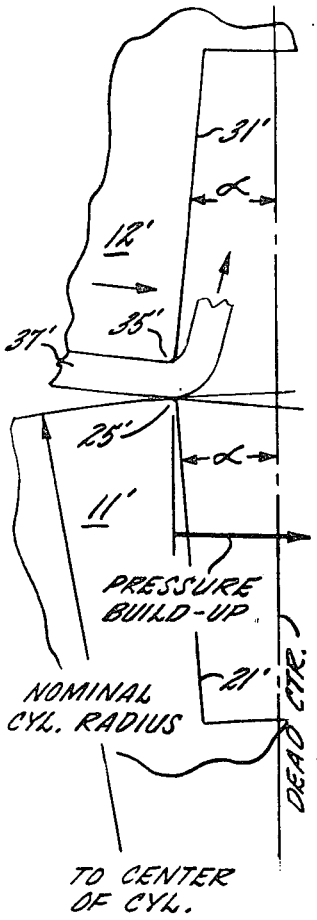

FIG. 3 is an enlarged diagram showing the meeting of the edges defined by the grooves in the respective cylinders and showing the beginning of pressure build-up between the cylinders, absent the present invention.

Figure 4:
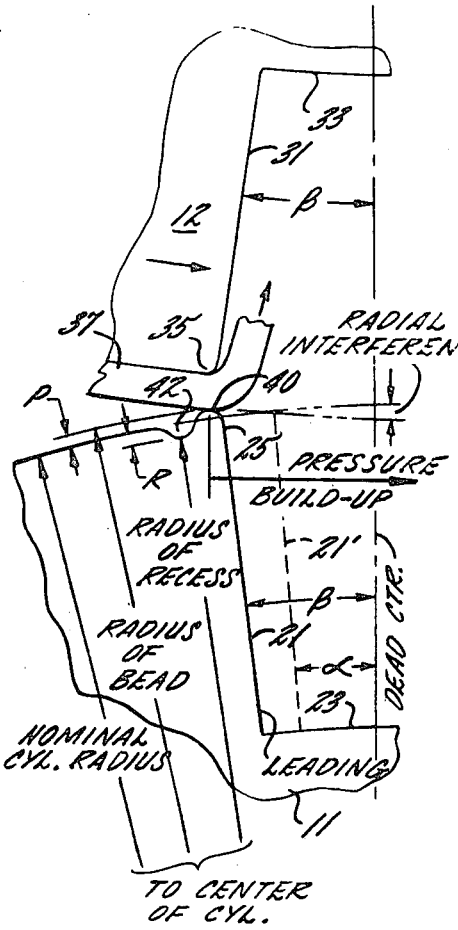

FIG. 4 shows the meeting of the leading edges defined by the grooves employing the bead of the present invention and showing the resultant enlargement of the pressure build-up angle related to the dead center condition.

Figure 5:
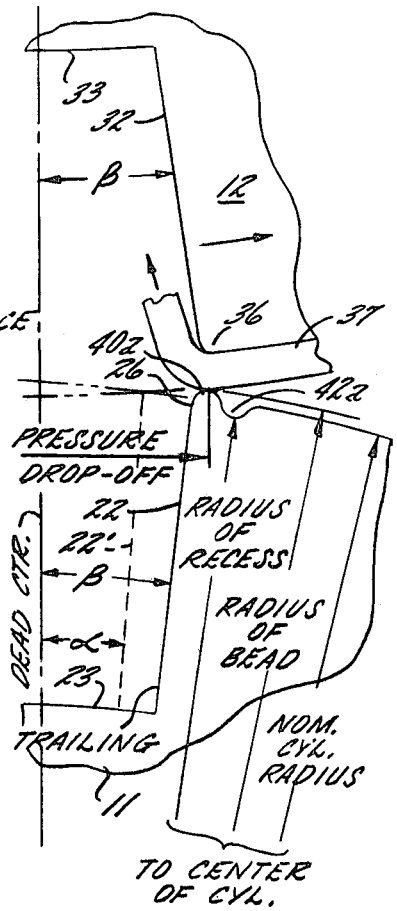

FIG. 5 is a diagram similar to FIG. 4 but showing the enlargement in drop-off angle resulting from the present invention.

Figure 6:
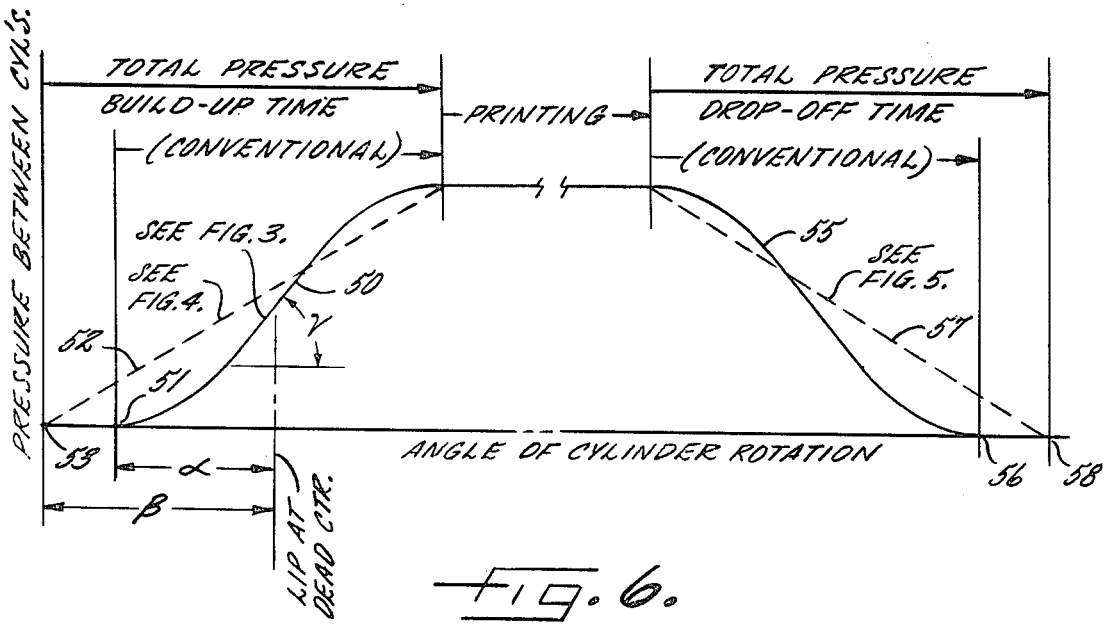

FIG. 6 is a generalized plot of pressure between the cylinders as a function of angle of rotation, with the dashed lines showing the reduction in the rate of change of force both upon build-up and upon drop-off which characterize use of the present invention.

While the invention has been described in connection with a preferred embodiment, it will be understood that I do not intend to limit the invention to the particular embodiment shown but intend, on the contrary, to cover the various alternative and equivalent forms of the invention included within the spirit and scope of the appended claims.

Turning now to the drawings there is disclosed in FIG. 1 a first, or impression, cylinder 11 and a second, or blanket cylinder 12 having shafts 13, 14, respectively, journaled in bearings 15, 16 mounted in the press frame, of which a fragmentary portion has been indicated at 17.

The first cylinder has a longitudinal groove 20 defining leading and trailing end walls 21, 22 which are oriented at a generally radial direction as well as a bottom wall 23, the end walls terminating at the surface 24 of the cylinder in lips 25, 26. The groove 20 is normally provided for mounting of tensioning and take-up devices for a thin protective covering (not shown) which is usually stretched over the surface of an impression cylinder.

Similarly, the second, or blanket, cylinder 12 has a groove 30 defining leading and trailing end walls 31, 32 which are radially oriented, and a bottom wall 33, with the end walls determining the limits of the outer surface 34. The end walls 31, 32 terminate in lips 35, 36 at the outer surface. Stretched over the outer surface 34 and about the lips 35, 36 is a resilient blanket of rubber or rubber-like material 37. It will be understood that the ends of the blanket are tensioned by tension and take-up devices (not shown) mounted on the bottom wall 33, as conventional.

In the lithographic process a plate cylinder 38, having a plate mounted thereon, is in rolling engagement with the blanket 37. The image from the plate cylinder, following transfer to the blanket, is then "offset" onto a sheet of paper passing between the blanket and impression cylinders and held in place by grippers (not shown) on the latter. All three of the cylinders 11, 12, 38 are driven at the same peripheral speed by a press drive 39, adjacent cylinders being driven in opposed synchronous relation so that the grooves 20, 30 pass opposite one another, momentarily releasing the pressure between them.

FIG. 1 shows a condition in which the grooves are passing one another, rotating in the directions shown, with the cylinders about to resume contact. Under such zero pressure conditions the shaft 14 of the upper, or blanket, cylinder, by reason of play P, occupies a position at the "bottom" of the bearing 16 in which it is journaled, dropping there of its own weight. This has moved the cylinder 12 closer to the cylinder 11. Also the cylinder 12 is in the relaxed state, rather than being elastically flexed upwardly, which serves to bring the cylinders a little closer to one another. Finally the two cylinders are intentionally adjusted toward one another into a slightly interfering relation so that the impression cylinder, with the sheet it supported upon it, slightly indents the blanket to establish printing pressure. These three factors, added together, produce a total radial interference indicated at I in FIG. 1 when the cylinders are in the relaxed state, with grooves opposed, the interference being greatly magnified in this figure for purposes of illustration.

In accordance with the present invention, rather than cushioning or flatting the lip on the leading end wall of the first cylinder 11, the lip is provided with a bead which extends longitudinally and which projects a small distance outwardly from the nominal radial dimension, of the cylinder thereby causing the lip on the leading end wall to engage the blanket surface of the second cylinder earlier in the cycle than it would in the absence of the bead thereby to enlarge the pressure build-up angle of the cylinders and to cause a more gradual build-up of pressure between them to the operating level. Thus, referring especially to FIGS. 2 and 2*a*, the lip 25 of the leading end wall 21, and which is at the outer surface 24 of the cylinder, is formed with a longitudinal bead 40 which projects radially beyond the outer surface 24 of the cylinder. The bead is of rounded profile having an "outboard" side 41 which merges smoothly with the surface of the leading end 21 of the groove. Further in accordance with the invention there is provided a recess which extends continuously along the "inboard" side of the groove, such recess being indicated at 42. The recess has a radius, from the center of the cylinder to its root, which is less than the nominal radius of the cylinder.

Thus referring to FIG. 2*a* the significant dimensions of the bead and its recess, related to the surface 24 of the cylinder, are set forth. It will be seen that the bead 40 projects a distance P above the surface of the cylinder whereas the recess is depressed a distance R. The dimensions R and P are, in a practical case, of the same general order of magnitude, say between a sixteenth of an inch and an eight of an inch. The bead preferably has a width, measured in the circumferential direction of w while the recess has a width W. These are also of an equal order of magnitude, with the recess width W being at least as great as the width w of the bead. The bead and recess, taken together, are smoothly joined so as to resemble a sine wave which is, in turn, smoothly merged with the cylinder surface 24.

The improvement brought about by the present invention may be understood and appreciated by comparing FIG. 3, which represents conventional construction, with the diagram in FIG. 4 which includes the bead of the present invention. Both diagrams are based upon the existence of the same amount of radial interference between the cylinders. Because of this radial interference the lip 25', which determines the beginning of the printing area, engages the blanket 37' on the impression cylinder at an angle ahead of dead center. This angle, which is indicated at $\alpha$, represents the angle during which build-up of force between the cylinders takes place prior to the lip 25' reaching its dead center position. This angle is relatively narrow resulting in a high rate of force increase. In other words the slope of the force curve is steep as indicated by the "full line" curve 50 in FIG. 6 where the slope has a maximum angle $\gamma$. Note that one of the reasons for the steep slope is the fact that the force does not begin to rise until the point 51 is reached.

By contrast, where a bead 40 is used, contact between the cylinders takes place earlier in the cycle so that more time is provided for the pressure build-up to occur which corresponds to a slower build-up of the pressure between the cylinders. This is shown by the dashed curve 52 in FIG. 6. All of the other factors being the same, presence of the bead 40 causes initial engagement between the cylinders to occur at an angle $\beta$, related to dead center, an angle which is substantially enlarged as compared to the angle $\alpha$. In short, with use of the bead, build-up of force occurs earlier, at a point 53 on the pressure diagram. The force between the cylinders, rising from point 53, increases along a slope which is substantially more shallow than that at 50 where the bead is absent, the operating pressure, when finally achieved, however, being the same.

The dashed curve 52, in addition, rises initially at a higher rate and is more linear than the curve 52. The reason for this is that the relatively deep initial penetration of the bead into the blanket develops a relatively high, although localized, reaction force. While the dashed curve 52 corresponding to the use of the bead is illustrated as being linear, such curve may, in a practical case, depart somewhat from true linearity, but analysis shows that, in any event, the maximum rate of force build-up utilizing the bead is less than in conventional construction and much less than where flatting or cushioning techniques are employed. The more shallow rate of pressure build-up characterizing the present invention seems to have a disproportionate effect in reducing "striping". This is believed due to the fact that striping is due to elastic vibration of the cylinder. Where the rate of change of pressure is reduced, substantially less energy is imparted to the cylinders and thus available for rebound.

In practicing the invention in its preferred form a longitudinally extending recess is employed at the inboard side of the bead. The use of such recess does not have any direct effect upon the angle of pressure build-up, for example, the angle $\beta$. The main purpose of the recess is to facilitate penetration by the bead and to enable the bead to develop a high reaction pressure when the bead is initially engaged and to neutralize the additional radial force exerted at the bead when the blanket rotates from a position shown in FIG. 4 to a position of full engagement with the printing surface, for example when the bead is approaching and passing the dead center condition. Under such condition of full engagement, the reduction in pressure upon the blanket over a longitudinal strip the width of the recess tends to neutralize the increase in pressure upon the blanket along the adjacent longitudinal strip occupied by the bead.

While the above discussion has been concentrated upon the function of the bead 40 at the leading edge of the printing area, it is one of the features of the present invention that a similar bead 40*a* and recess 42*a* (FIG. 5) are used at the trailing edge 22 to enlarge the pressure drop-off angle thereby to prolong the drop-off period and thus reduce the rate of drop-off.

Absent use of the bead the pressure drop off from the operating level is illustrated by the curve 55 in FIG. 6, with the drop-off being completed at the point 56. However, by using the bead the pressure drop-off angle is enlarged, and the drop-off time is extended. Thus the drop-off curve, indicated by the dashed line 57, extends all of the way out to point 58, having a slope which is substantially less than that which exists conventionally in the absence of a bead.

In short, by using upraised beads at the leading and trailing edges of the printing area, the rate of pressure build-up and the rate of pressure drop-off are both substantially reduced to minimize vibration and "striping" without necessity for resorting to expensive support arrangements as disclosed, for example, in the above-mentioned U.S. patent.

By making the bead of smoothly rounded profile merging smoothly with the recess and by merging the recess, in turn, smoothly into the cylinder surface, sharp edges are avoided and the blanket is protected against wear. It will be appreciated in that the benefits of the bead and adjacent recess can be achieved at low cost and without having to pay a penalty in the form of a change in some other one of the operating conditions. While it is true that the bead and recess slightly encroach upon the printing area, the extreme ends of the printing area are almost always employed for marginal purposes so the printing capacity is, as a practical matter, not affected.

For incorporating the present invention into a cylinder conveniently and at lowest possible cost, it is proposed that the bead 40 and its recess 42 be incorporated in a bar-shaped insert such as illustrated at 60 in FIG. 2*a* fitted to and secured upon a ledge or shoulder 62 machined in the cylinder.

While the invention has been described in connection with a combination of an impression cylinder and a blanket cylinder in a lithographic press, it will be apparent that the invention is not limited thereto and is usable wherever a rigid cylinder and a resiliently surfaced cylinder, with synchronously rotated grooves formed in both of them, are in pressure engagement with one another and where the effect of the resulting gap is to reduce the pressure momentarily to zero during each cycle of rotation.

Also while the invention has been described assuming that the bead and its recess are of constant profile along the entire length of the cylinder, it will be appreciated by one skilled in the art that this is not an essential in the practicing of the invention. Similarly, although the bead and recess extend longitudinally of the cylinder they do not necessarily have to extend its entire length and minor variations in height and extent may be made as desired without departing from the invention.

What is claimed is:

1. A rotary printing press including a frame, first and second cylinders journaled in the frame in rolling engagement and biased against one another to produce a force at an operating level, each of the cylinders having a longitudinal groove defining a gap in the cylinder surface, means for driving the cylinder so that the gaps are rotated in opposed synchronism with one another, the first cylinder being rigid and the second cylinder being resiliently covered, the groove in the first cylinder defining leading and trailing end walls oriented in a generally radial direction as well as a bottom wall, with the end walls terminating at lips at the cylinder surface, the lips on the end walls each having a bead projection which extends longitudinally therealong and which projects a small distance outwardly from the nominal radial dimension of the cylinder thereby causing the lip on the leading end wall of the first cylinder to engage the surface of the second cylinder earlier than it would in the absence of a bead and causing the lip on the trailing end wall to separate from the surface of the second cylinder later than it would in the absence of a bead thereby to enlarge the pressure build-up and pressure drop-off angles of the cylinders and to cause a more gradual build-up of pressure between them to the operating level as well as a more gradual decrease from the operating level.

2. A rotary printing press including a frame, first and second cylinders journaled in the frame in rolling engagement and biased against one another to produce a force at an operating level, each of the cylinders having a longitudinal groove defining a gap in the cylinder surface, means for driving the cylinders so that the gaps are rotated in opposed synchronism with one another, the first cylinder being rigid and the second cylinder being resiliently covered, the groove in the first cylinder defining leading and trailing end walls oriented in a generally radial direction as well as a bottom wall, with the end walls terminating at lips at the cylinder surface, the lip on the leading end wall of the first cylinder having a bead projection which extends longitudinally therealong and which projects a small distance outwardly from the nominal radial dimension of the cylinder thereby causing the lip on the leading end wall to engage the surface of the second cylinder earlier in the cycle than it would in the absence of the bead thereby to enlarge the pressure build-up angle of the cylinders and to cause a more gradual build-up of pressure between them to the operating level.

3. A rotary printing press including a frame, first and second cylinders journaled in the frame in rolling engagement and biased against one another to produce a force at an operating level, each of the cylinders having a longitudinal groove defining a gap in the cylinder surface, means for driving the cylinders so that the gaps are rotated in opposed synchronism with one another, the first cylinder being rigid and the second cylinder being resiliently covered, the groove in the first cylinder defining leading and trailing end walls oriented in a generally radial direction as well as a bottom wall, with the end walls terminating at lips at the cylinder surface, the lip on the trailing end wall having a bead projection which extends longitudinally therealong and which projects a small distance outwardly from the nominal radial dimension of the cylinder thereby causing the lip on the trailing end wall of the first cylinder to separate from the second cylinder later than it would in the absence of the bead thereby to enlarge the pressure drop-off angle of the cylinders and to cause a more gradual decrease of pressure between them from the operating level.

4. The combination as claimed in claim 2 or in claim 3 in which a recess extends continuously along the inboard edge of the bead, the recess having a radius at the root which is less than the nominal radius of the cylinder.

5. The combination as claimed in claim 2 or in claim 3 in which a recess extends continuously along the inboard edge of the bead, the recess having a radius at the root which is less than the nominal radius of the cylinder, the depth of the recess with respect to the cylinder surface being approximately equal to the projection of the bead above the nominal cylinder surface.

6. The combination as claimed in claim 2 or in claim 3 in which a recess extends continuously along the inboard edge of the bead, the recess having a radius at the root which is less than the nominal radius of the cylinder, the width of the recess measured circumferentially being at least as great as the width of the bead.

7. The combination as claimed in claim 2 or in claim 3 in which the bead has a rounded cross section and merges smoothly on its outboard side with the adjacent end wall of the groove thereby to minimize wear on the resilient covering of the second cylinder.

8. The combination as claimed in claim 2 or in claim 3 in which a recess extends continuously along the inboard edge of the bead, the recess having a radius at the root which is less than the nominal radius of the cylinder, the profile of the bead and recess taken together being generally of sine wave shape.

* * * * *